US005196162A

United States Patent [19]

Maki et al.

[11] Patent Number: 5,196,162

[45] Date of Patent: Mar. 23, 1993

[54] TI-AL TYPE LIGHTWEIGHT HEAT-RESISTANT MATERIALS CONTAINING NB, CR AND SI

[75] Inventors: Kunio Maki, Yokohama; Mamoru Sayashi, Miura; Susumu Isobe; Tomohito Iikubo, both of Nagoya; Toshiharu Noda, Chita, all of Japan

[73] Assignees: Nissan Motor Co., Ltd., Kanagawa; Dido Steel Co., Ltd., Aichi, both of Japan

[21] Appl. No.: 747,824

[22] Filed: Aug. 21, 1991

[30] Foreign Application Priority Data

Aug. 28, 1990 [JP] Japan ..... 2-225778

[51] Int. Cl.[5] ..... C22C 14/00

[52] U.S. Cl. ..... 420/418; 148/421; 420/421

[58] Field of Search ..... 420/418, 421; 148/421

[56] References Cited

U.S. PATENT DOCUMENTS

| | | | |
|---|---|---|---|
| 4,849,168 | 7/1989 | Nishiyama et al. | 420/418 |
| 5,045,406 | 9/1991 | Huang | 420/418 |
| 5,098,653 | 3/1992 | Chin | 420/418 |

FOREIGN PATENT DOCUMENTS

| | | |
|---|---|---|
| 0363598 | 4/1990 | European Pat. Off. . |
| 0455005 | 11/1991 | European Pat. Off. . |
| 1-255632 | 10/1989 | Japan . |

*Primary Examiner*—Upendra Roy
*Attorney, Agent, or Firm*—Pennie & Edmonds

[57] ABSTRACT

A Ti-Al type lightweight heat-resistant consists essentially of 32 to 36% w of Al, 0.1 to 2.0% w of Si, 0.1 to 5.0% w of Nb, 0.1 to 3.0% w of Cr, and optionally 0.005 to 0.200% w of B, the balance being substantially Ti. The alloy has improved oxidation resistance together with excellent ductility and strength at room temperature and high temperature.

10 Claims, 1 Drawing Sheet

TI-AL TYPE LIGHTWEIGHT HEAT-RESISTANT MATERIALS CONTAINING NB, CR AND SI

BACKGROUND OF THE INVENTION

1. Field of the Invention

The present invention relates to titanium-aluminium (Ti-Al)type lightweight heat-resistant materials, and particularly to Ti-Al type lightweight heat-resistant materials which are useful for the manufacture of various machine parts.

2. Description of the Prior Art

Recently, for realizing higher performance and higher efficiency of engines and the like, parts to be used for high-speed reciprocating movement, such as engine valves, pistons and rocker arms, or parts to be used for high-speed rotation, such as turbine blades and turbocharger rotors for gas turbines and jet engines, are required to be more and more lightweight and excellent in heat resistance. Therefore, researches and developments on materials used for these parts have been extensively carried on in order to meet such requirements.

At present, as materials for these parts, nickel(Ni)-base superalloys are predominantly used. Other materials used therefor are titanium alloys and ceramic materials. However, the Ni-base superalloys have a disadvantage in that they are heavyweight, and the ceramic materials have a disadvantage in that they are inferior in ductility and hence unreliable as materials for the above parts.

Ti-Al type alloys based on Ti-Al intermetallic compounds have recently been made much account of as a material for the above parts. The Ti-Al alloy is much lighter in weight in comparison to the Ni-based superalloys, and superior in ductility in comparison to the ceramic materials. However, the Ti-Al alloy has a disadvantage in comparison to the Ni-base superalloys and the ceramic in that the oxidation resistance of the Ti-Al alloy deteriorates at high temperature, above 800° C. It has been found that the oxidation resistance of the Ti-Al alloy is improved by adding a combination of niobium (Nb) and silicon (Si).

The Ti-Al alloy containing Si/Nb has excellent specific tensile strength (strength/density) which is equal to that of a typical Ni-base superalloy such as Inconel 713C. However, the Ti-Al-Si-Nb alloy still has a disadvantage in that its ductility at room and high temperatures is low, making it brittle. Accordingly, it is desirable to improve the ductility of the Ti-Al-Si-Nb alloy.

While addition of manganese (Mn), chromium (Cr) or the like to the Ti-Al alloy has been contemplated to improve the ductility of the alloy at room temperature, there has been no development for improving the ductility of Ti-Al-Si-Nb alloy, thereby simultaneously improving the ductility and the oxidation resistance of the Ti-Al alloy.

Accordingly, it has been eagerly desired to develop Ti-Al-Si-Nb alloys having improved ductility and strength at room temperature and high temperature without impairing their excellent oxidation resistance.

SUMMARY OF THE INVENTION

It is an object of the present invention to solve the above-mentioned problems, i.e., to provide a Ti-Al alloy containing Nb and Si, which is quite excellent in oxidation resistance as well as in strength and ductility at room temperature and high temperature.

This and other objects can be achieved according to the present invention by providing a Ti-Al type lightweight heat-resistant material comprising 32 to 36% by weight (% w) of Al, 0.1 to 2.0% w of Si, 0.1 to 5.0%w of Nb, 0.1 to 3.0%w of Cr; and optionally 0.005 to 0.200% w of boron (B); and optionally, at most 0.3% w of oxygen, at most 0.2% w of nitrogen (N) and at most 0.3% w of carbon (C); the balance being substantially Ti.

DETAILED DESCRIPTION OF THE PREFERRED EMBODIMENTS

Figure 1:
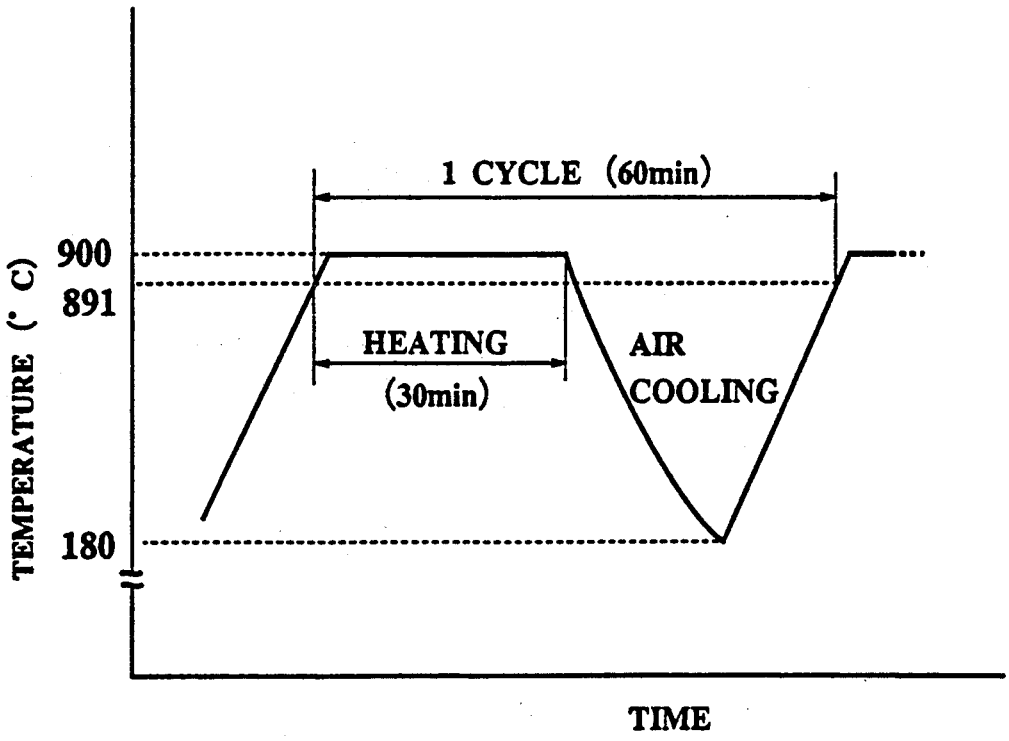
FIG. 1 is an explanatory diagram showing heating-/cooling cycle pattern for the cyclic oxidization test.

Next, reasons for the limitation of the content (% by weight) of each chemical component in the Ti-Al type lightweight heat-resistant material of the present invention will be explained.

Al: 32 to 36%

Al is the essential element for forming the intermetallic compounds TiAl and $Ti_3Al$ together with Ti. If Al content is too low, the volume fraction of $Ti_3Al$ becomes too high so that ductility is lowered and at the same time oxidation resistance becomes degraded. To the contrary, if Al content is too high, a single phase of TiAl is formed or the volume fraction of $Al_3Ti$ becomes too high, so that ductility is lowered. In order to obtain a two-phase alloy of TiAl/$Ti_3Al$ with excellent strength and ductility, it is necessary that the volume fraction of $Ti_3Al$ in the TiAl/$Ti_3Al$ two-phase alloy be 5 to 40%. This is why Al content is limited to the range of from 32 to 36% w.

Si: 0.1 to 2.0%

The above-mentioned TiAl/$Ti_3Al$ two-phase alloy is more improved in oxidation resistance when Si is added to the alloy in combination with Nb than when only Si is added thereto. It is from Si content of 0.1% w that this effect of Si appears under coexistence with Nb. However, if Si content exceeds 2.0%, the ductility at ordinary temperature is lowered by formation of a large amount of Si compounds. This is why Si content is limited to the range of from 0.1 to 2.0% w in the present invention. A more preferable range is from 0.2 to 1.0% w.

Nb: 0.1 to 5.0%

Also in the case of Nb, the above-mentioned oxidation resistance is more improved when Nb is added to the alloy in combination with Si than when only Nb is added. It is from Nb content of 0.1%w that this effect of Nb appears under coexistence with Si. The oxidation resistance increases with increase of Nb content, but it becomes saturated substantially at Nb content of 5.0%. Therefore, the upper limit of Nb content is 5.0% in the present invention. If Nb content exceeds 5.0%, because of high specific gravity of Nb, specific gravity of the Ti-Al type material becomes so high that the original feature of lightness of the Ti-Al type material is diminished. Besides since Nb is very expensive, the cost should be unnecessarily increased if Nb is added excessively. A more preferred range of Nb content is from 0.1 to 3.0% w.

Cr: 0.1 to 3.0%

Cr is dissolved in both of TiAl and $Ti_3Al$, but solubility into TiAl is relatively high. When Cr is dissolved in TiAl, strength and ductility of the alloy are enhanced due to solution strengthening. It is from Cr content of 0.1% w that such effect appears. On the other hand, if Cr content exceeds 3.0%, the effect becomes saturated and moreover adverse effects on ductility and oxidation resistance increase. Accordingly, in the present invention, the range of Cr content is limited to 0.1 to 3.0% w. A more preferred range of Cr content is from 0.1 to 2.0% w.

B 0.005 to 0.200%

The addition of B to the TiAl/$Ti_3Al$ two-phase alloy has the effect of crystal grain refining, and hence improving ductility at high temperature. Moreover, the addition of B has the effect of improving the castability of the alloy. It is from B content of 0.005% that such effects appear. On the other hand, if B content exceeds 0.200%, a large amount of $TiB_2$ precipitates so that strength and ductility of the alloy are degraded. Therefore, if B is added, it is necessary that B content is in the of 0.005 to 0.200% w.

C: 0 to 0.3%

The C dissolved in TiAl and $Ti_3Al$ increases the strength by solution strengthening. However, when C content exceeds 0.3% w, the ductility is lowered. Therefore, it is preferred to control the content to at most 0.3% w.

O: 0 to 0.3%

The O as well as C dissolved in TiAl and $Ti_3Al$ increases the strength by solution strengthening. However, when O content exceeds 0.3% w, the ductility is deteriorated. Therefore, it is preferred to control the content to at most 0.3% w.

N: 0 to 0.2%

The N as well as C and O dissolved in TiAl and $Ti_3Al$ increases the strength by solution strengthening. However, when N content exceeds 0.2% w, the ductility is lowered. Therefore, it is preferred to control the content to at most 0.2% w.

Ti: balance

Ti is the essential element for forming the compounds TiAl and $Ti_3Al$ together with Al in the two-phase alloy of TiAl/$Ti_3Al$, and thus constitutes substantially the balance of the composition.

The Ti-Al type lightweight heat-resistant alloy having the above-mentioned chemical composition shows the best characteristics when the structure has fine TiAl/$Ti_3Al$ lamellae. Accordingly, it is not preferred to subject the alloy to a heat treatment at such a high temperature that the lamellar spacing is enlarged or spherical $Ti_3Al$ is formed.

The lightweight heat-resistant alloy can be easily produced by the melting method. However it is also possible to produce the material by the powder method.

It is possible to manufacture various lightweight heat-resistant machine parts with the Ti-Al alloy of the present invention not only by the casting method but also by the forging method, since the alloy of the present invention enhanced ductility as compared with the conventional alloys.

The volume fraction of $Ti_3Al$ in TiAl/$Ti_3Al$ two-phase alloy significantly affects the strength and ductility. The composition of the Ti-Al type lightweight heat-resistant material in the present invention designed to contain 5 to 40% volume fraction of TiAl gives high strength and high ductility. The addition of the combination of Si and Nb markedly improves oxidation resistance; and at the same time addition of Cr greatly enhances ductility and strength at room temperature and high temperatures. Further, addition of B has the effect of crystal grain refining, and this, in conjunction with the effect of Cr addition, improves not only the ductility at high temperature but also improves forgeability of the alloy. In addition, since the melting point of the alloy is lowered by addition of the respective elements, castability is also improved.

EXAMPLES

In these examples, spongy Ti, granular Al and pure metals of the other elements to be added were used as starting materials to prepare alloys having the chemical compositions shown in Tables 1A (Examples according to the present invention) and 1B (Comparative Examples). Each alloy was melted by a plasma-skull melting furnace in argon atmosphere and cast into ingot of about 5 kg.

Next, test pieces to be used for tensile test and oxidation test were cut out directly from each ingot in the cast condition.

The tensile test was carried out at room temperature, 700° C. and 900° C., while the cyclic oxidation test was carried out by measuring weight increase due to oxidation under the condition of repeated heating up to 900° C./cooling cycles shown in Table 3.

The results of these tensile and oxidation tests are shown in Tables 2A (Examples according to the present invention) and 2B (Comparative Examples).

TABLE 1A

| EXAMPLE NO. EXAMPLES ACCORDING TO THE PRESENT INVENTION | CHEMICAL COMPOSITION (% W) OF ALLOY | | | | | | | | | | | | |
|---|---|---|---|---|---|---|---|---|---|---|---|---|---|
| | Al | Si | Nb | Cr | Mn | V | Mo | B | Zr | C | O | N | Ti |
| 1 | 33.3 | 0.2 | 0.9 | 0.5 | — | — | — | — | — | 0.05 | 0.05 | 0.02 | Bal.* |
| 2 | 33.5 | 0.2 | 1.1 | 0.9 | — | — | — | — | — | 0.04 | 0.08 | 0.03 | Bal. |
| 3 | 33.8 | 0.6 | 1.0 | 1.9 | — | — | — | — | — | 0.05 | 0.10 | 0.04 | Bal. |
| 4 | 33.1 | 0.5 | 1.0 | 0.3 | — | — | — | 0.10 | — | 0.06 | 0.12 | 0.04 | Bal. |
| 5 | 33.3 | 0.5 | 1.0 | 0.5 | — | — | — | — | — | 0.02 | 0.09 | 0.07 | Bal. |
| 6 | 33.5 | 1.0 | 0.9 | 2.8 | — | — | — | — | — | 0.03 | 0.08 | 0.08 | Bal. |
| 7 | 33.3 | 0.6 | 2.4 | 0.5 | — | — | — | — | — | 0.07 | 0.11 | 0.05 | Bal. |

*BAL: BALANCE

TABLE 1B

| EXAMPLE NO. COMPARATIVE EXAMPLES | CHEMICAL COMPOSITION (% W) OF ALLOY | | | | | | | | | | | | |
|---|---|---|---|---|---|---|---|---|---|---|---|---|---|
| | Al | Si | Nb | Cr | Mn | V | Mo | B | Zr | C | O | N | Ti |
| 8 | 33.5 | 0.2 | 0.9 | 4.7 | — | — | — | — | — | 0.03 | 0.06 | 0.01 | Bal. |

TABLE 1B-continued

| EXAMPLE NO. COMPARATIVE EXAMPLES | CHEMICAL COMPOSITION (% W) OF ALLOY | | | | | | | | | | | | |
|---|---|---|---|---|---|---|---|---|---|---|---|---|---|
| | Al | Si | Nb | Cr | Mn | V | Mo | B | Zr | C | O | N | Ti |
| 9 | 33.8 | — | — | — | — | — | — | — | — | 0.05 | 0.06 | 0.01 | Bal. |
| 10 | 33.1 | 1.0 | 0.9 | — | — | — | — | — | — | 0.06 | 0.05 | 0.02 | Bal. |
| 11 | 33.5 | 0.8 | 1.0 | — | 1.5 | — | — | — | — | 0.01 | 0.40 | 0.01 | Bal. |
| 12 | 34.0 | — | 0.5 | 0.5 | 0.9 | 0.5 | 0.6 | 0.01 | 0.5 | 0.03 | 0.07 | 0.02 | Bal. |
| 13 | 33.5 | 0.2 | 1.0 | — | — | — | — | — | — | 0.02 | 0.03 | 0.09 | Bal. |
| 14 | 33.4 | — | 1.1 | 0.6 | 1.1 | — | — | 0.02 | — | 0.42 | 0.12 | 0.09 | Bal. |
| 15 | 34.5 | 0.9 | 1.3 | 3.5 | — | — | — | 0.01 | — | 0.08 | 0.16 | 0.26 | Bal. |

*BAL: BALANCE

TABLE 2A

| EXAMPLE NO. EXAMPLES ACCORDING TO THE PRESENT INVENTION | TENSILE CHARACTERISTICS | | | | | | OXIDATION RESISTANCE |
|---|---|---|---|---|---|---|---|
| | AT ROOM TEMPERATURE | | AT 700° C. | | AT 900° C. | | WEIGHT INCREASE DUE TO OXIDATION |
| | TENSILE STRENGTH (kgf/mm²) | ELONGATION (%) | TENSILE STRENGTH (kgf/mm²) | ELONGATION (%) | TENSILE STRENGTH (kgf/mm²) | ELONGATION (%) | (g/m²) |
| 1 | 57.6 | 2.4 | 65.0 | 4.3 | 53.4 | 22.0 | 71 |
| 2 | 61.7 | 2.1 | 67.6 | 5.8 | 56.3 | 17.9 | 133 |
| 3 | 63.1 | 2.3 | 69.0 | 6.2 | 57.5 | 15.3 | 182 |
| 4 | 56.9 | 2.2 | 64.8 | 3.9 | 52.6 | 20.9 | 40 |
| 5 | 60.5 | 2.3 | 65.7 | 5.1 | 53.9 | 20.3 | 47 |
| 6 | 61.4 | 1.8 | 65.9 | 4.4 | 53.4 | 17.6 | 176 |
| 7 | 62.2 | 2.3 | 67.2 | 5.6 | 54.8 | 16.7 | 37 |

TABLE 2B

| EXAMPLE NO. COMPARATIVE EXAMPLES | TENSILE CHARACTERISTICS | | | | | | OXIDATION RESISTANCE |
|---|---|---|---|---|---|---|---|
| | AT ROOM TEMPERATURE | | AT 700° C. | | AT 900° C. | | WEIGHT INCREASE DUE TO OXIDATION |
| | TENSILE STRENGTH (kgf/mm²) | ELONGATION (%) | TENSILE STRENGTH (kgf/mm²) | ELONGATION (%) | TENSILE STRENGTH (kgf/mm²) | ELONGATION (%) | (g/m²) |
| 8 | 61.4 | 2.1 | 67.2 | 6.0 | 56.6 | 14.7 | 329 |
| 9 | 53.2 | 2.0 | 56.0 | 8.0 | 41.1 | 7.0 | 413 |
| 10 | 40.0 | 0.6 | 44.8 | 1.8 | 42.9 | 25.6 | 33 |
| 11 | 52.3 | 1.5 | 54.0 | 4.0 | 43.2 | 10.5 | 90 |
| 12 | 48.3 | 1.9 | 52.8 | 15.2 | 45.5 | 28.6 | 237 |
| 13 | 47.1 | 2.3 | 48.2 | 3.6 | 45.1 | 17.5 | 67 |
| 14 | 45.0 | 0.5 | 47.1 | 1.2 | 41.2 | 3.4 | 215 |
| 15 | 39.2 | 0.8 | 43.4 | 0.9 | 36.5 | 2.9 | 287 |

TABLE 3

| CYCLIC OXIDATION TEST CONDITIONS | |
|---|---|
| SIZE OF TEST PIECE | 3 × 10 × 25 (mm) |
| HEATING TIME | 96 HRS./900° C. |
| HEATING/COOLING PATTERN | SHOWN IN FIG. 1 |
| NUMBER OF REPETITION OF HEATING/COOLING CYCLE | 192 TIMES |
| ATMOSPHERE | DEW POINT: 20° C., IN A SYNTHETIC AIR |

As seen from Tables 1A, 1B, 2A and 2B, in comparative examples 8 and 12 concerning conventional Ti-Al type materials, weight increase due to oxidation is extremely large, which indicates inferior oxidation resistance. Comparative examples 10 and 13 to which Cr is not added are inferior in strength and ductility. Comparative example 11 to which Cr is not added but Mn is added is not inferior in oxidation resistance and ductility, however, it is unsatisfactory in strength. Comparative example 9 to which Si and Nb are not added is extremely inferior in oxidation resistance. Comparative example 14 not containing Si and comparative example 15 containing too much Cr are inferior in oxidation resistance.

In contrast to the materials of comparative examples, all of the Ti-Al type lightweight heat-resistant materials in examples 1 to 7 relating to the present invention possess improved oxidation resistance together with excellent strength and ductility at room temperature and high temperature.

It has been seen that the Ti-Al lightweight heat-resistant material according to the present invention which is excellent in oxidation resistance as well as in strength and ductility at room temperature and high temperature as stated above, is quite suitable for machine parts performing high speed reciprocating movement which are used at high temperature and to which less inertia is desired and for machine parts performing high-speed rotation which are used at high temperature and for which less time lag is required.

What is claimed is:

1. A Ti-Al type lightweight heat-resistant alloy exhibiting improved oxidation resistance and ductility consisting essentially of: 32 to 36% by weight of Al; a combination of 0.1 to 2.0% by weight of Si and 0.1 to 5.0% by weight of Nb to improve oxidation resistance; and 0.1 to 3.0% by weight of Cr to improve ductility and strength, the balance being substantially Ti.

2. The Ti-Al alloy according to claim 1, wherein the alloy has a metallographical lamellar structure formed with a TiAl and $Ti_3Al$ phases.

3. The ti-Al alloy according to claim 1, wherein improved oxidation resistance of the alloy is characterized by weight increase due to oxidation not exceeding 182 $g/m^2$ after subjecting the alloy to 192 cycles of 60 minute heat/cooling treatment, each cycle being 30 minutes of heating at about 900° C. and 30 total minutes of cooling to 180° C. and reheating to 900° C.

4. The Ti-Al alloy according to claim 2, wherein the TiAl phase has a content of 5 to 40% by volume.

5. A ti-Al type lightweight heat-resistant alloy exhibiting improved oxidation resistance and ductility consisting essentially of: 32 to 36% by weight of Al; a combination of 0.1 to 2.0% by weight of Si and 0.1 to 5.0% by weight of Nb to improve oxidation resistance; 0.1 to 3.0% by weight of Cr to improve ductility and strength; and 0.005 to 0.200% by weight of B to further improve ductility at high temperature in conjunction with Cr to improve forgeability of the alloy, the balance being substantially Ti.

6. The Ti-Al alloy according to claim 1 or 5, further including 0 to 0.3% by weight of O, 0 to 0.2% by weight of N, and 0 to 0.3% by weight of C.

7. The Ti-Al alloy according to claim 1 or 5, wherein the amount of Si is 0.2 to 1.0% by weight.

8. The Ti-Al alloy according to claim 1 or 5, wherein the amount of Nb is 0.1 to 3.0% by weight.

9. The Ti-Al alloy according to claim 6, wherein the amount of Si is 0.2 to 1.0% by weight.

10. The Ti-Al alloy according to claim 6, wherein the amount of Nb is 0.1 to 3.0% by weight.

* * * * *